US005215023A

United States Patent [19]

Johnson

[11] Patent Number: 5,215,023

[45] Date of Patent: Jun. 1, 1993

[54] TRAPEZE LINE ANCHOR

[76] Inventor: Allen H. Johnson, Box 119, Waverly, Nova Scotia, Canada, B0N 2S0

[21] Appl. No.: 853,805

[22] Filed: Mar. 19, 1992

[51] Int. Cl.[5] ..... B63H 9/10

[52] U.S. Cl. ..... 114/39.2; 114/89

[58] Field of Search ..... 114/39.2, 89, 97, 98, 114/270, 102, 103

[56] References Cited

U.S. PATENT DOCUMENTS 4,763,591 8/1988 Taylor ..... 114/39.2
4,873,934 10/1989 Renault ..... 114/39.2

FOREIGN PATENT DOCUMENTS 1193146 9/1985 Canada .
2843751 4/1980 Fed. Rep. of Germany ..... 114/39.2
3232908 3/1984 Fed. Rep. of Germany ..... 114/39.2

*Primary Examiner*—Edwin L. Swinehart
*Attorney, Agent, or Firm*—James Ray & Associates

[57] ABSTRACT

An adjustable line anchor assembly to secure both ends of a trapeze line to the boom of a sailboard is described. One end of the anchor carries a spool onto which the trapeze line winds. The spool permits the line length of the trapeze to be easily adjusted, even while sailing. The spool has locking means to lock the spool at a given setting. This prevents the slipping or release of the trapeze line while sailing. A clamp allows the position of the anchor on the boom to be easily adjusted while sailing.

17 Claims, 2 Drawing Sheets

TRAPEZE LINE ANCHOR

BACKGROUND OF THE INVENTION

1. Field of the Invention

The present invention relates to a trapeze line anchor assembly to fasten a trapeze line to a boom on a sailboard.

2. Description of the Prior Art

The sport of windsurfing or board sailing has become very popular in recent years. To perform this sport the user, or skipper, stands on the board and supports the sail by holding the boom of the sailboard. In order to relieve some of the weight from the arms, the skipper often wears a harness with a hook protruding from the front at about the level of the waist. A trapeze line, which is a short length of rope fastened to the boom, is then placed on the hook. There is a separate trapeze line on either side of the boom.

U.S. Pat. No. 4,763,591 describes an adjustable trapeze or harness line for board sailing. The trapeze line is attached at each end to the boom of the sailboard between 80 and 90 centimeters apart. A hand loop is formed in one end of the trapeze line which allows for the length of the line to be quickly shortened while sailboarding.

U.S. Pat. No. 4,873,934 describes an adjustable sheet or trapeze line for a windsurfing harness which is attached to the boom of a windsurfing board. The line passes inside the boom through a hole in the boom and emerges from the boom to thread into a dual acting clamp attached to the boom. A button is on the exterior of the clamp that is depressed to lengthen or shorten the line. The disadvantage of such a system is that it is difficult to install and involves complicated mechanisms to shorten or lengthen the trapeze line. Also, it requires a modification of the boom which would allow water ingress and does not allow fore and aft adjustment of the lines.

SUMMARY OF THE INVENTION

The present invention relates to a trapeze line anchor assembly to be used in board sailing to fasten the trapeze line to the boom.

Accordingly, the present invention provides an adjustable trapeze line anchor assembly for securing a trapeze line to a boom on a sailboard, said assembly comprising:

a base;

guide means on said base for engagement with the boom for movement of the base longitudinally thereof;

clamping means to secure the base to the boom at any selected location, said clamping means having an engaged condition wherein the base will be locked to the boom and a released condition wherein the base will be free to slide along the boom;

means to attach the trapeze line to the base; and adjustment means to adjust the trapeze line length.

Therefore, both ends of the trapeze line are attached to the anchor which is in turn attached to the boom. The clamp allows the entire assembly to be easily moved along the boom to enable adjustment of the fore and aft position of the trapeze line relative to the boom while sailing.

One end of the trapeze line winds on to a spool so that the line length can be easily adjusted while sailing and while hooked into the trapeze. The spool has locking means to allow the trapeze line to be locked at a given position to prevent spontaneous release or take up of the line. Preferably the locking means consists of a tooth ring and a toothed locking ring that have complementary teeth to allow these rings to engage and lock the spool at a desired position.

Therefore, the trapeze line anchor of the present invention has advantages over known systems in that both the fore and aft line position and line length can be easily adjusted while sailing. The clamp maintains the selected fore and aft position and the locking means in the spool prevents slipping of the line while in use.

DETAILED DESCRIPTION OF A PREFERRED EMBODIMENT

The following is a description, by way of example, of a preferred embodiment of the present invention, reference being had to the above described drawings.

Figure 1:
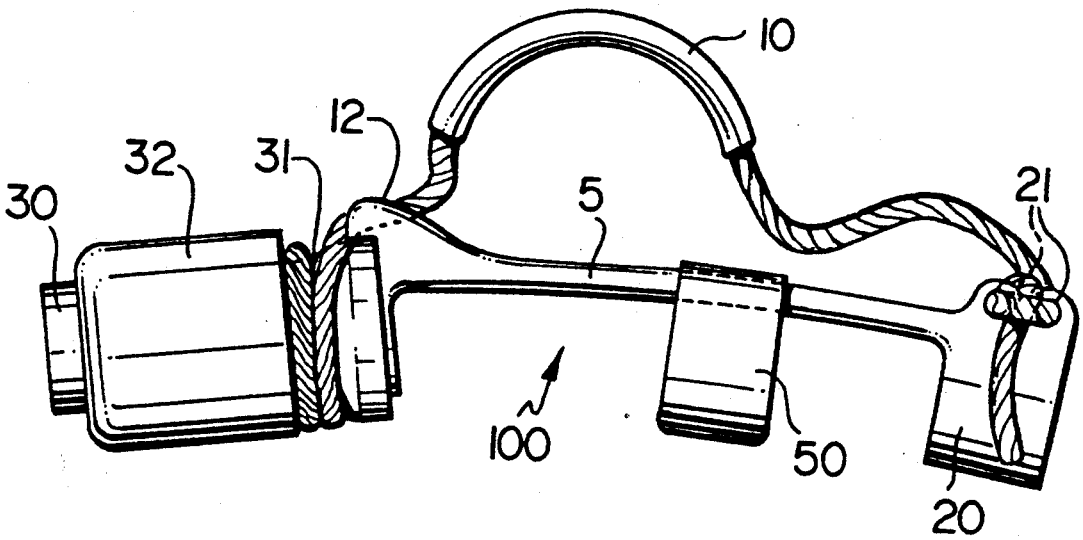
FIG. 1 is a plan view of a preferred embodiment of the trapeze line anchor assembly of the present invention.

Referring to FIG. 1, the trapeze line anchor assembly 100 consists of a bowed longitudinal member 5. One end of the member carries a short tubular sleeve 20 having two eyes 21 there in. The other end of the member carries a longer tubular sleeve 30. The bowed longitudinal member 5 has a tubular clamp 50 attached thereto, for attaching the anchor assembly to the boom, the member 5 being sufficiently flexible to accomodate the curvature of the boom.

Figure 3:
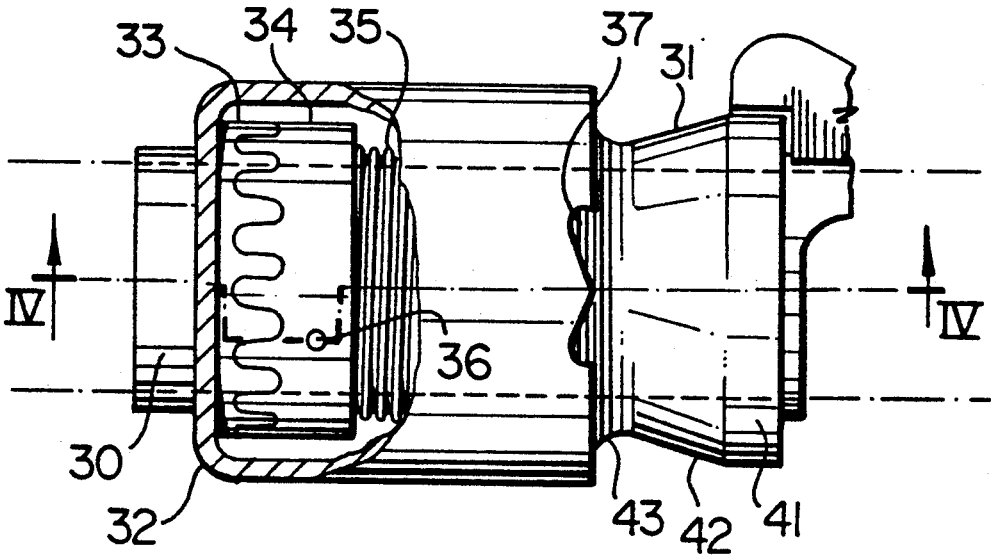
FIG. 3 is an enlarged partially sectioned view of the spool portion of the trapeze line anchor assembly.
Figure 4:
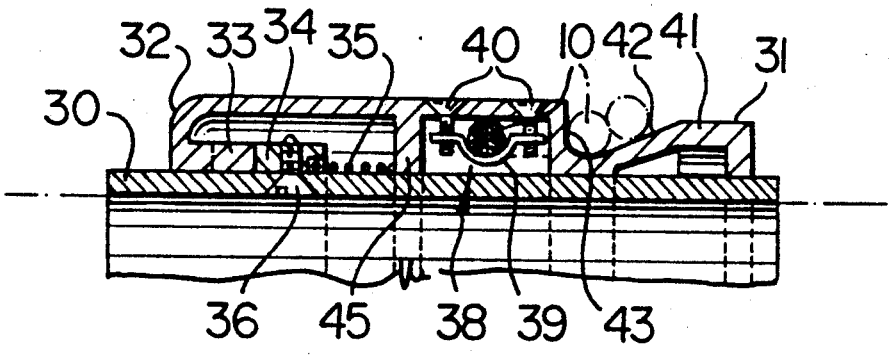
FIG. 4 is a sectional view taken on the line IV-IV in FIG. 3.

Referring to FIGS. 3 and 4, the spool 31 is generally cylindrical and is a unitary structure that consists of a short end section 41, followed by a tapered section 42, a radial shoulder 43, and a longer cylindrical grip section 32 or hand grip. As seen in FIG. 4, the spool 31 closely surrounds the sleeve 30 but is movable relative thereto.

The interior of the spool, shown partially in FIG. 3 and in section in FIG. 4, has an integral toothed ring 33. A toothed locking ring 34 is attached to the sleeve 30 by one or more screws 36. The toothed ring 33 and the locking ring 34 have complementary interengageable teeth as seen in FIG. 3. A coiled compression spring 35 surrounding the sleeve 30 within the grip section 32 is compressed between one end of the locking ring 34 and an annular wall 45 in the spool 31 and presses the latter to the right as seen in FIGS. 3 and 4. Movement of the spool slightly to the left in FIG. 3 compresses the spring 35 to disengage the toothed ring 33 and the locking ring 34 to allow rotation of the spool to take up or release the trapeze line. When hand pressure is removed, the spool moves to the right by the force of the spring 35 causing the toothed ring 33 and the locking ring 34 to engage thus preventing rotation of the spool. This position essentially locks the spool at a desired position.

One end of the trapeze line 10 is fixed in the interior of the spool by clamp 38 that consists of a strap 39 with two screws 40 attached thereto. Referring to FIG. 4, the line 10 can be placed within the space between the strap 39 and the grip section 32. The screws 40 can then be rotated to tighten the strap and secure the line 10 in place. The spool has line entry ports 37 to allow the trapeze line to enter the spool. The other end of the trapeze line 10 attaches to the end 20 of the anchor by passing the line through the two eyes and the free end then passing under the section of line between the eyes.

Figure 2:
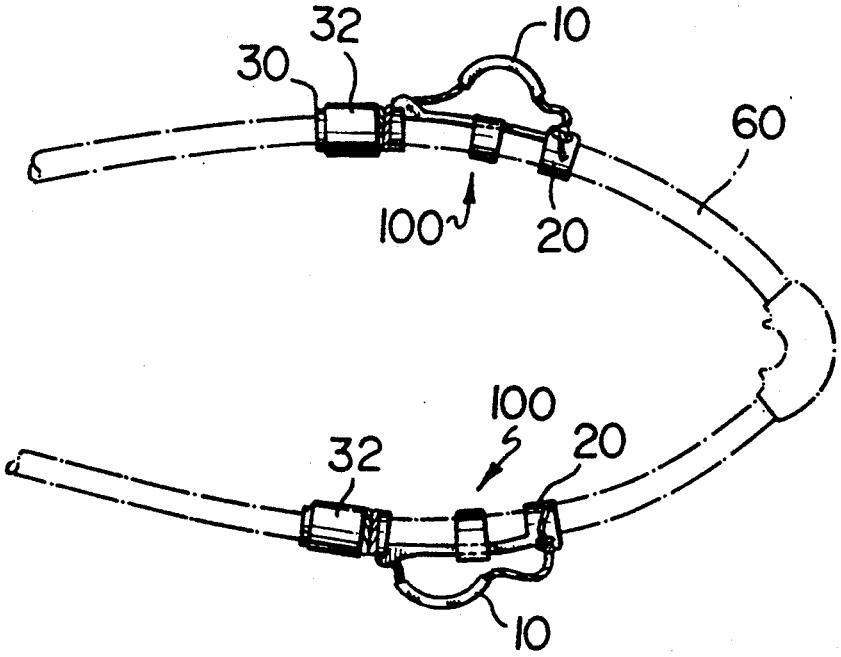
FIG. 2 shows, to a smaller scale, a plan view of a wishbone boom for a sailboard with two trapeze line anchor assemblies, one mounted on each side of the boom.
Figure 5A:
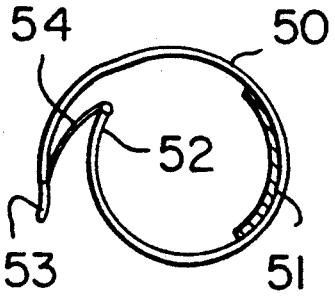
FIGS. 5*a* and 5*b* are end views (taken from the right in FIG. 1) of the clamp that can be used with the trapeze line anchor assembly.
Figure 5B:
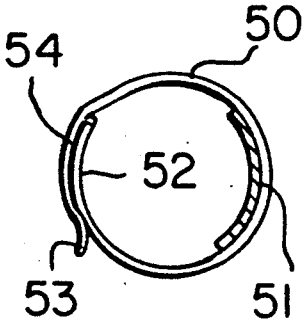

The tubular clamp 50 is attached to the central portion of the anchor 5 and can clamp the entire assembly to the boom 60 of a sailboard as shown in FIG. 2. The sleeves 20 and 30 allow the ends of the anchor to be placed over the boom 60 of a sail board, thus permitting the assembly to move longitudinally thereon. The clamp is shown in more detail in FIG. 5. FIG. 5*a* shows the clamp in its open position and FIG. 5*b* in its closed position. The clamp can be attached to the middle section 5 of the anchor 100 or can be formed integral with the anchor. The attachment point is shown as 51. The clamp has resilient arms 52 and 53 that are at their ends joined by a short rigid strap 54. In the closed position (FIG. 5*b*), the clamp is generally circular in outline with the ends of the arms 52 and 53 overlapping and closed on each other. This causes the anchor and the boom to be pressed together to prevent movement of the anchor along the boom. The clamp can be easily opened by pulling upward on arm 53 to spread the arms apart as shown in FIG. 5*a*. In this position the clamp loosely surrounds the anchor and the boom to permit longitudinal movement of the anchor on the boom. The clamp can be formed from a variety of materials such as aluminum or plastic. The strap 54 can be made of plastic or of stainless steel with stainless steel hinge pins at either end where it joins the clamp. The anchor can be formed entirely of plastic with the exception of the spring and the screws.

In practice, two trapeze line anchor assemblies are used, one on each side of the boom 60 as shown in FIG. 2. The position of the anchor along the boom can be easily adjusted by opening the clamp, sliding the anchor to the desired location and then closing the clamp to lock the anchor in place. The skipper can adjust the length of the trapeze line 10 by sliding the spool 31 in the direction to cause compression of the spring 35 to disengage the toothed ring 33 and locking ring 34. The hand grip 32 can then be rotated to adjust the length of trapeze line 10. Once the desired length is achieved, the skipper releases the spool which moves in the opposite direction by the force of the spring 35 and thus causes engagement of the rings 33 and 34 to lock the spool at this position. The adjustments of both position and line length as described above are performed with the skipper's harness hooked onto the trapeze line and a light pressure applied to the line by the harness. During adjustments, both hands are on the boom in position to control the sail. As can be appreciated from the above description, the skipper can easily adjust the length of the trapeze line and/or the position of the anchor assembly along the boom during sailing, by performing the appropriate procedure, as described above.

While the above description relates to a preferred embodiment of the present invention, it is to be appreciated that various modifications can be made to the anchor assembly without departing from the scope and spirit of the present invention.

What I claim as my invention is:

1. An adjustable anchor assembly for securing a trapeze line to a sailboard boom, said anchor comprising:

(a) an elongate base;

(b) guide means on said base, said guide means being releasably engageable with a sailboard boom to guide said base for movement longitudinally of such boom;

(c) clamping means on said base, said clamping means being manually actuable between an engaged condition for locking said base with respect to the boom, and a released condition for freeing said base for movement along the boom; and (d) means to attach a trapeze line on said base to form a trapeze line loop having longitudinally spaced first and second ends.

2. The anchor assembly according to claim 1 including adjustment means to adjust the length of the trapeze line loop, said adjustment means comprising:

a spool rotatably on said mounted base to receive in wound condition thereon a length of the trapeze line, rotation of the spool being effective to add or withdraw trapeze line from said one end of said loop; and manually releasable spool locking means that is automatically engageable to secure the spool against rotation.

3. The anchor assembly according to claim 2 where said spool is carried on one end of said base, the base having an opposite second end forming an attachment for said second end of the trapeze line loop.

4. The anchor assembly according to claim 1 wherein said clamping means consists of a single stroke, hand operable clamp configured to be manipulated selectively to and from said engaged position by a single hand of a user.

5. The anchor assembly according to claim 1 wherein said guide means comprises two annular elements respectively located at opposite ends of the base, said annular elements being sized to receive the sailboard boom therethrough said clamping means comprising a contractable band carried on said base and sized to encircle the sailboard boom.

6. The anchor assembly according to claim 5 wherein said assembly has a profile that is adapted to lie closely against the boom such that in use no part of the assembly projects excessively from the boom to hamper or obstruct operation of the sailboard.

7. The anchor assembly according to claim 2 wherein said spool locking means comprises at least two interlockable parts, one carried by said spool and one carried by said base, said spool being axially movable under the force of a spring to interlock said parts and compression of the spring by manual axial displacement of said spool being effective to disengage said parts to permit rotation of the spool.

8. The anchor assembly according to claim 7 wherein said interlockable parts are two toothed rings.

9. The anchor assembly according to claim 1 wherein said guide means comprises at least one tubular sleeve in said base.

10. The anchor assembly according to claim 1 wherein said base has a curvature to accommodate the curvature of the boom.

11. The anchor assembly of claim 10 wherein said base is flexible to allow for accommodation of the curvature of the boom.

12. The anchor assembly according to claim 2 wherein said spool locking means comprises at least two interlockable parts, one carried by said spool and one carried by said base, said spool being axially movable under the force of a spring to interlock said parts and compression of the spring by manual axial displacement of said spool being effective to disengage said parts to permit rotation of the spool.

13. The anchor assembly according to claim 12 wherein said interlockable parts are two toothed rings.

14. An adjustable anchor assembly for securing a trapeze line to a sailboard boom, said anchor assembly comprising:

(a) an elongate base;

(b) guide means on said base, said guide means being releasably engageable with a sailboard boom to guide said base for movement longitudinally of such boom;

(c) clamping means on said base being selectively operable between an engaged condition wherein said base will be locked to the boom, and a released condition wherein said base will be free to slide along the boom, said clamping means comprising a clamp that is configured to be actuated manually by one hand of a user of the sailboard;

(d) means to attach a trapeze line to the base so that a free length of such trapeze line is available for engagement by the user of the sailboard; and (e) adjustment means on said base to adjust said free length.

15. An anchor assembly according to claim 14 wherein said clamp is configured to be movable between said released condition and said engaged condition through manipulation by one hand of the user.

16. The anchor assembly according to claim 14 wherein said adjustment means comprises:

a spool rotatably mounted on the base to receive the trapeze line in wound condition thereof such that rotation of the spool causes paying out or take up of the trapeze line with respect to said spool, and manually releasable spool locking means to secure the spool against rotation, said locking means being automatically engageable.

17. The anchor assembly according to claim 14 wherein said guide means comprises two annular elements respectively located at opposite ends of the base, said annular elements being sized to receive the sailboard boom therethrough, said clamping means comprising a contractable band carried on said base and sized to encircle the sailboard boom.

* * * * *